US005411436A

United States Patent [19]

Kaplan

[11] Patent Number: 5,411,436

[45] Date of Patent: May 2, 1995

[54] CURRENCY DISPENSER

[76] Inventor: Jeffrey I. Kaplan, 18 Buck Rd., East Brunswick, N.J. 08816

[21] Appl. No.: 961,063

[22] Filed: Oct. 14, 1992

Related U.S. Application Data

[63] Continuation of Ser. No. 709,651, Jun. 3, 1991, abandoned.

[51] Int. Cl.[6] ..... G07D 1/08

[52] U.S. Cl. ..... 453/17; 221/94; 453/20

[58] Field of Search ..... 453/2, 17, 19, 20–30, 453/32, 33, 34, 37, 38, 40, 41, 63; 206/0.81, 0.83, 0.84; 235/7 A; 221/93, 94

[56] References Cited

U.S. PATENT DOCUMENTS

| | | | |
|---|---|---|---|
| 3,020,916 | 2/1962 | Buchholz et al. | 453/20 |
| 3,126,023 | 3/1964 | Nagy | 453/17 X |
| 3,167,078 | 1/1965 | Trautenberg | 453/21 |
| 3,316,924 | 5/1967 | Ware | 453/61 |
| 3,934,692 | 1/1976 | Novak et al. | 453/41 X |
| 4,126,147 | 11/1978 | Brisebarre et al. | 453/20 |
| 4,359,062 | 11/1982 | Uecker et al. | 453/40 X |
| 4,944,391 | 7/1990 | Johnson | 206/0.83 |

FOREIGN PATENT DOCUMENTS

| | | | |
|---|---|---|---|
| 0245391 | 9/1989 | Japan | 453/29 |
| 2026749 | 2/1980 | United Kingdom | 453/17 |

*Primary Examiner*—F. J. Bartuska

[57] ABSTRACT

A currency dispenser which is installed in an automotive vehicle and which includes a plurality of switches that may be optionally set to dispense different amounts of coins. Each switch is associated with a different toll and the driver simply pushes the proper switch when he approaches the toll. Optionally, dispensing of the currency may be activated by the driver's hand being placed beneath the dispenser.

17 Claims, 2 Drawing Sheets

CURRENCY DISPENSER

This application is a continuation of application Ser. No. 07/709,651, now abandoned, filed Jun. 3, 1991.

TECHNICAL FIELD

This invention relates to currency dispensers, and more particularly, to an improved currency dispenser for use in a vehicle, for example, at tollbooths by an automobile driver.

DESCRIPTION OF THE PRIOR ART

Coin holders are well known in the art and have been extensively used in automobiles. Typically, a plurality of slots are provided and different denominations of coins are stored therein. Upon arrival at a highway toll booth, the driver selects the proper combination of coins for payment of the toll, removes them from their slots, pays the toll, and proceeds therethrough.

The problem with this system is that the driver's view is distracted as he arrives at the tollbooth for the time it takes to select the proper combination of coins, tokens, and/or bills. This creates a safety problem and may result in accidents.

Another problem is that driver's often arrive at "exact change" toll booths, only to realize that they do not have exact change. This backs up traffic behind the driver and further delays the driver.

Several attempts at solving this problem have been described in the prior art. For example, U.S. Pat. No. 4,944,391 discloses a novel coin container with a plurality of compartments. Each compartment dispenses the proper amount of coins for a toll as the compartment is uncovered by a slidable member. The device provides some solution to the problem, but it is not perfect. The driver must listen for a specific click to determine when the compartment is uncovered. Moreover, no method of dispensing bills, in addition to the coins, is provided.

The problem remaining in the prior art is to provide a safe, convenient, and inexpensive technique to dispense predetermined currency combinations to drivers as they need to pay tolls.

SUMMARY OF THE INVENTION

The above and other problems are overcome in accordance with the invention which relates to an improved currency dispenser for use in an automobile. In accordance with one embodiment of the invention, a plurality of switches are provided, each switch being associated with a different amount of money. When the driver pushes the switch, the associated amount of money is dispensed into a dish, for example. Thus, as the driver is arriving at the tollbooth, he pushes the switch, and when he does arrive at the toll, the dish contains the exact amount needed.

In accordance with other aspects of the invention, the switches may be preset to dispense various amounts of money, the dispensing may be delayed until the driver's hand is placed beneath the apparatus, and the entire device may be mounted on the driver's side door for convenient access.

DETAILED DESCRIPTION OF THE PREFERRED EMBODIMENTS

Figure 1:
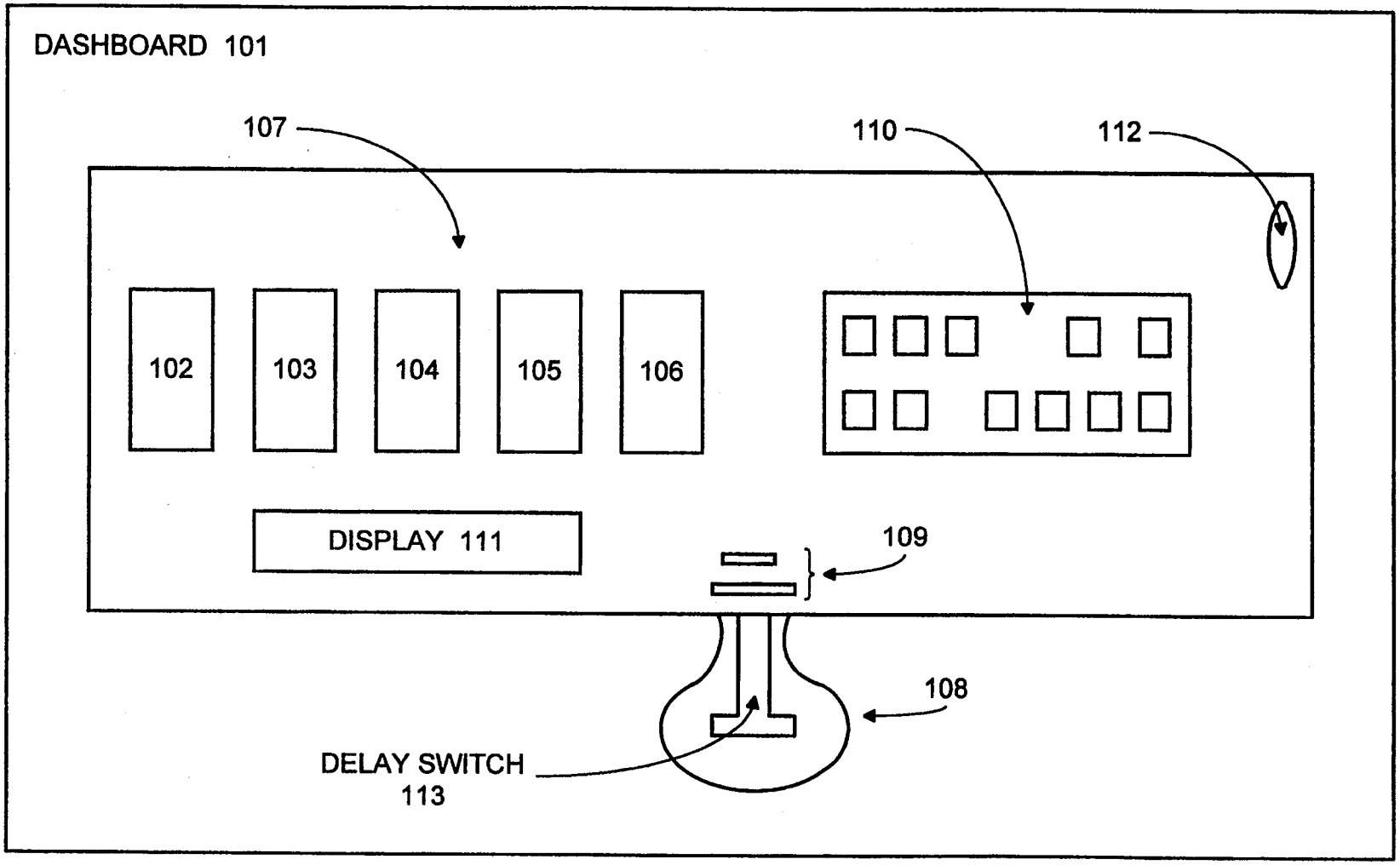
FIG. 1 is a high level block diagram of the currency dispenser installed in a dashboard of a vehicle.

FIG. 1 shows a block diagram of the currency dispenser 107 installed in the dashboard 101 of an automobile. Each of switches 102–106 is associated with a different amount of currency to be dispensed. A predetermined amount of currency, which may be in the form of coins, tokens, and/or bills, is stored in a locked box (not shown) behind dashboard 101.

In operation, the driver presets each of the switches to an associated amount of money by utilizing the store keypad 110. This is done in a manner similar to the technique used to prestore telephone numbers in telephones which have an autodial feature. For example, the driver may push a first key "store", a second key which corresponds to one of storage location 1–5, and then enter the amount to be stored. Each of the storage locations 1–5 corresponds to a separate one of switches 102–106, and thus, the amount stored in storage locations 1–5 is the amount associated with the switches 102–106, respectively. Ideally, the driver should set the switches for tolls known to be frequently encountered. It is of course understood that while five switches have been used for exemplary purposes, any number of switches may be used.

During driving, as the driver approaches a toll, he pushes the switch associated with the amount of that toll and the proper combination of currency, in the form of coins or tokens, is dispensed from one of slots 109 into dish 108. The switches may be reset to reflect toll increases. The other of slots 109 may be optionally utilized to dispense bills for those tolls which cost several dollars. After the currency is dispensed, the driver simply scoops it from dish 108 for payment.

Optionally, the dish 108 may be replaced supplemented with a delay switch which, when pushed, allows dispensing of the currency Thus, when the proper one of buttons 102–106 is depressed, the currency dispenser is set, but the associated amount of currency is not dispensed until the delay switch is pushed. The delay switch will be large enough to be activated by a human hand and thus, after pushing the switch, the currency will only be dispensed when the driver places his hand beneath the dispenser and thus activates the delay switch, thereby allowing dispensing of the currency directly into the driver's hand.

Display 111 allows the amount of currency associated with each of switches 102–106 to be displayed on demand and also permits the value being stored to be displayed as the currency dispenser is loaded with the several preset values. Finally, keyhole 112 allows for selective locking of the device for loading more currency and for forbidding use of the device so that when the vehicle is left at a parking garage and the ignition key given to the attendant, the currency dispenser may be locked and its use prohibited. Of course, separate keys may be used for the functions of allowing use of the currency dispenser and for allowing access to the loading of the currency.

It may be desirable to provide either a visual or audible alarm so that when the amount of currency falls below a predetermined value, or when the amount of tolls that can be paid falls below a predetermined value, an alarm is activated. The alarm may be audible, or may be displayed on display 111 for example. The electronics for implementing such a system are well known in the art and will therefore not be described in great detail herein.

It is understood that while FIG. 1 shows the currency dispenser being mounted on the dashboard, it may be mounted anywhere convenient to the driver. Specifically, it is believed that installation into the driver side door of the vehicle would be convenient to some drivers, as it would allow them to conveniently take the currency and place it outside the drivers window for delivery to a tollbooth attendant or machine.

Figure 2:
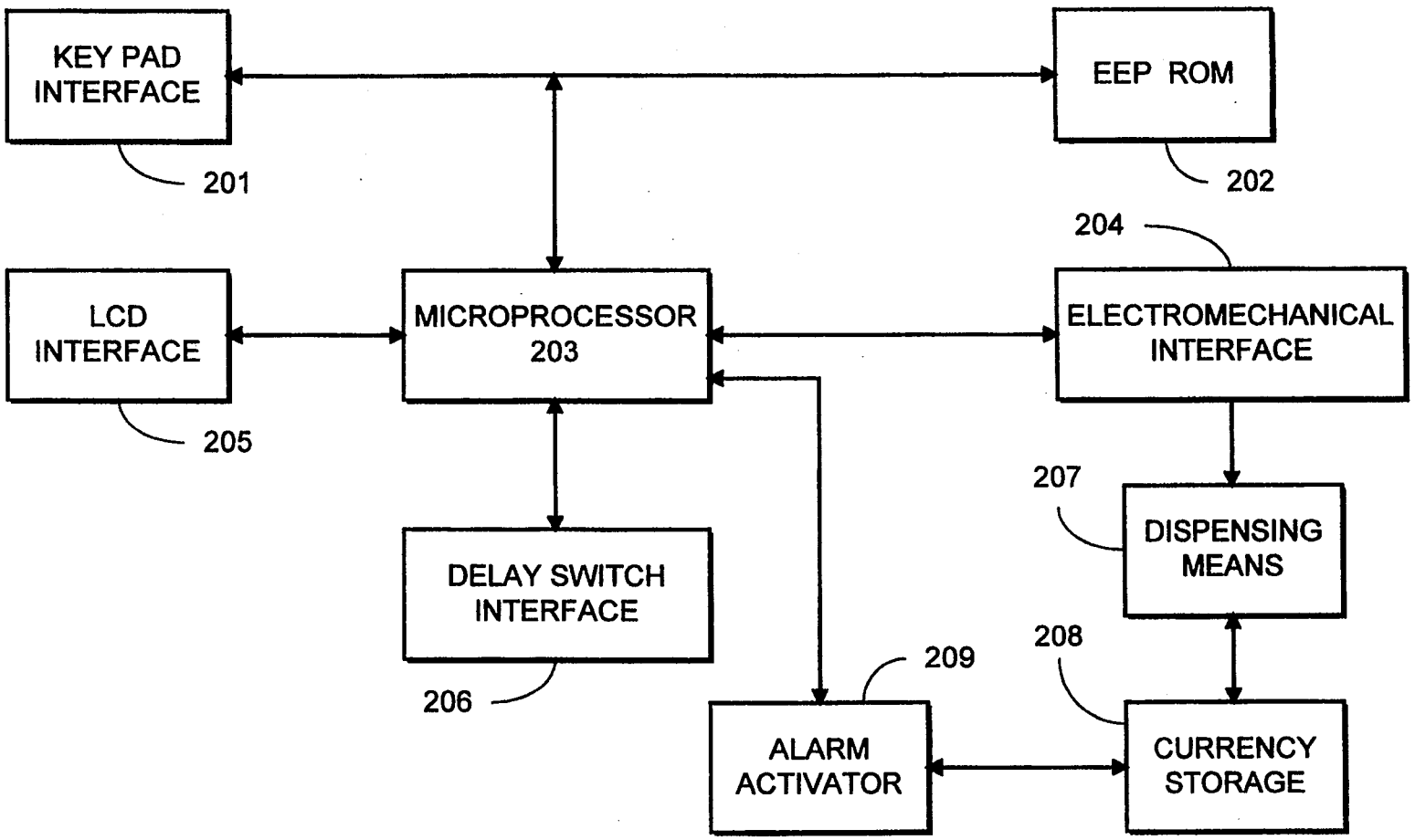
FIG. 2 is a high level block diagram of exemplary electronics for implementing the currency dispenser.

FIG. 2 shows a conceptual block diagram of the internal electronics of the currency dispenser. The details of electromechanical coin dispensers are well known in the art and are used for example, in soda machines for dispensing change and in electronic dollar bill changers. Thus, FIG. 2 shows only the basic building blocks, and the electronics for implementing these functions can be constructed in numerous ways by those of ordinary skill in the art.

Keypad interface 201 accepts switch activations for currency to be dispensed and also accepts inputs from the user to be stored as previously described. Microprocessor 203 determines the type of input arriving, and either stores the input data in EEPROM 202 or utilizes the data to dispense currency. In the former case, microprocessor 203 will cause the data to be loaded into EEPROM 202 in accordance with well known techniques for allowing electronic data to be entered by a user and stored in memory. Additionally, the amount being stored may be displayed and verified via LCD interface 205. All of this is well known and is used in many fields such as electronic storage of prices in vending machines, user configurable function keys on personal computers, etc.

In the case of the input data being a switch for selecting data, microprocessor 203 activates electromechanical interface 204 and causes the proper amount of currency to be dispensed. Electromechanical interface 204 may also be built using a variety of well known techniques in use in, for example, change machines and dollar bill changers. Delay switch interface 206 may optionally be employed to delay dispensing of the currency until a delay switch is activated by a human hand being placed beneath the currency dispenser as previously discussed.

It is understood that while the above describes the preferred embodiment of the invention, various modifications may be made without violating the spirit and scope thereof. For example, rather than a delay switch, a light beam or other sensor can be used. Moreover, while the description above shows bills, coins, and tokens being dispensed, the invention may operate with only coins, only bills, only tokens, or any combination thereof. For purposes herein, currency means tokens, coins, bills, or any combination thereof. Additionally, even for currency comprising only one of these three types, different denominations are intended to be included in the definition of currency. For example, even currency consisting only of coins may include quarters, nickels, dimes, etc.

The locking means may be coupled electronically to the ignition, so that insertion of one ignition key starts the car and unlocks the currency dispenser for use, while insertion of another ignition key starts the car only but does not unlock the currency dispenser. The currency dispenser is normally locked when no key is inserted. Thus, when the driver leaves a key with a parking garage attendant, the attendant will be given the proper key to start the car but not to allow access to or use of the currency dispenser.

The amount associated with each switch may be displayed directly on or nearby that switch.

I claim:

1. A currency dispenser capable of being used in a vehicle, said currency dispenser comprising:

a plurality of switches, each switch being associated with a predetermined amount of currency;

means for dispensing the currency if the associated switch is activated, where the amount of currency dispensed may include pieces of currency of different values;

and means for allowing a user to select and store values indicative of particular amounts of currency to be associated with each switch said means for allowing including a plurality of user accessible switches.

2. The currency dispenser of claim 1 wherein said means for dispensing further includes a delay switch for inhibiting dispensing of said currency until said delay switch is activated.

3. The currency dispenser of claim 1 further comprising at least one dish for receiving the dispensed currency.

4. The currency dispenser of claim 1 further comprising means for storing a predetermined amount of currency for later dispensing.

5. The currency dispenser of claim 4 further comprising means for activating an alarm when the amount of currency stored is below a predetermined value or when the amount of tolls that can be paid with the stored currency is below a predetermined value.

6. The currency dispenser of claim 4 further comprising locking means for selectively inhibiting access to said stored currency.

7. The currency dispenser of claim 1 connected to a driver side door of a vehicle.

8. The currency dispenser of claim 1 connected to a dashboard of a vehicle.

9. The currency dispenser of claim 1 further comprising a display for indicating said values being stored.

10. The currency dispenser of claim 1 further comprising locking means for selectively inhibiting use of said dispenser.

11. The currency dispenser of claim 1 wherein the currency is comprised of different denominations of coins.

12. The currency dispenser of claim 1 including nonvolatile and erasable memory for storing the values.

13. A currency dispenser mounted in a vehicle, said currency dispenser comprising:

a plurality of switches, said switches being mounted within the vehicle and accessible to a driver of the vehicle;

a plurality of memory locations, each memory location being associated with a separate one of the switches each memory location for storing value indicative of a predetermined amount of currency; and means for dispensing the predetermined amount of currency when the switch associated with the memory location where the value indicative of said predetermined amount is activated, the value stored in at least one memory location representing an amount of currency that comprises a plurality of coins.

14. A currency dispenser according to claim 13 further comprising a display device for storing the values stored in each memory location.

15. A currency dispenser according to claim 14 wherein said memory comprise EEPROM.

16. A currency dispenser according to claim 15 mounted on a vehicle dashboard.

17. A currency dispenser of claim 15 further comprising means for delaying dispensing of said currency until a user's hand is placed therebeneath.

* * * * *